US008040210B2

(12) United States Patent
Kim et al.

(10) Patent No.: US 8,040,210 B2
(45) Date of Patent: Oct. 18, 2011

(54) ELECTROMAGNETICALLY OPERATED SWITCHING DEVICE

(75) Inventors: Tae Hyun Kim, Tokyo (JP); Akihiko Maruyama, Tokyo (JP); Tomotaka Yano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 235 days.

(21) Appl. No.: 12/441,206

(22) PCT Filed: Feb. 23, 2007

(86) PCT No.: PCT/JP2007/053369

§ 371 (c)(1),
(2), (4) Date: Mar. 13, 2009

(87) PCT Pub. No.: WO2008/038421

PCT Pub. Date: Apr. 3, 2008

(65) Prior Publication Data

US 2009/0284334 A1 Nov. 19, 2009

(30) Foreign Application Priority Data

Sep. 28, 2006 (JP) ..... 2006-265130

(51) Int. Cl.

| | |
|---|---|
| ***H01F 7/00*** | (2006.01) |
| ***H01F 1/00*** | (2006.01) |
| ***H01F 7/08*** | (2006.01) |
| ***H01H 47/00*** | (2006.01) |
| ***H01H 9/00*** | (2006.01) |

(52) U.S. Cl. ..... 335/219; 335/256; 335/266; 335/268; 361/139; 361/160

(58) Field of Classification Search ..... 335/219; 361/139, 160

See application file for complete search history.

(56) References Cited

U.S. PATENT DOCUMENTS

| | | | | |
|---|---|---|---|---|
| 3,401,288 | A * | 9/1968 | French | 310/168 |
| 3,412,971 | A * | 11/1968 | McDivitt | 251/129.1 |
| 3,580,267 | A * | 5/1971 | Baker | 137/203 |
| 3,678,274 | A * | 7/1972 | Kawashima | 250/379 |
| 3,870,931 | A * | 3/1975 | Myers | 361/194 |
| 6,076,490 | A * | 6/2000 | Esch et al. | 123/90.11 |
| 6,390,036 | B1 * | 5/2002 | Yuuki | 123/90.11 |
| 7,677,362 | B2 * | 3/2010 | Shimohata et al. | 187/288 |

(Continued)

FOREIGN PATENT DOCUMENTS

| | | |
|---|---|---|
| DE | 27 10 573 | 9/1978 |
| JP | 2001 6500 | 1/2001 |

(Continued)

*Primary Examiner* — Anh Mai
*Assistant Examiner* — Mohamad Musleh
(74) *Attorney, Agent, or Firm* — Oblon, Spivak, McClelland, Maier & Neustadt, L.L.P.

(57) ABSTRACT

A switching contact, an electromagnetically operated electromagnet for driving the switching contact, and a drive power source device for driving the electromagnetically operated electromagnet. The electromagnetically operated electromagnet includes a movable core coupled to a movable contact of the switching contact, a fixed core located in a peripheral portion of the movable core, and coils wound around the movable core and the fixed core. Currents are supplied to the coils to drive the movable core. Capacitors store charges for supplying the current to the coils. Resistors are arranged in series with a path through which the capacitors are connected with the coils of the electromagnetically operated electromagnet and through which a current for closing operation flows. Capacitances of the capacitors and values of the resistors are controlled to adjust a supplied current characteristic to the electromagnetically operated electromagnet.

4 Claims, 2 Drawing Sheets

U.S. PATENT DOCUMENTS

| | | | | |
|---|---|---|---|---|
| 7,766,128 | B2 * | 8/2010 | Takeuchi et al. | 187/393 |
| 2002/0044403 | A1 * | 4/2002 | Takeuchi et al. | 361/152 |
| 2007/0222427 | A1 * | 9/2007 | Takeuchi et al. | 324/71.2 |
| 2009/0138212 | A1 * | 5/2009 | Maruyama | 702/34 |

FOREIGN PATENT DOCUMENTS

| | | |
|---|---|---|
| JP | 2001 256868 | 9/2001 |
| JP | 2005 38630 | 2/2005 |
| JP | 2005 44612 | 2/2005 |

* cited by examiner

ELECTROMAGNETICALLY OPERATED SWITCHING DEVICE

TECHNICAL FIELD

The present invention relates to an electromagnetically operated switching device, and more particularly, to an electromagnetically operated switching device in which contactable and separatable electrodes included therein are driven by an electromagnet, and in which a pair of electrodes are opened or closed when the electrodes are brought into contact with or separated from each other.

BACKGROUND ART

According to a conventional electromagnetically operated switch, in a case of capacitor driving, charges are discharged from a capacitor to an electromagnetically operated unit (electromagnetic coil) to thereby generate an electromagnetic force in the electromagnetically operated unit to be driven (see, for example, Patent Document 1).

Patent Document 1: JP 2005-44612 A (page 12, line 39 to page 13, line 14, and FIGS. 8 and 9)

DISCLOSURE OF INVENTION

Problems to be Solved by the Invention

The conventional electromagnetically operated switch has the following problems.

When a weight of a movable portion including a movable contact portion of a vacuum valve is changed in the conventional electromagnetically operated switch, a speed of the vacuum valve becomes outside the specifications because of the change in weight. Even in a case where a charging capacitance or charging voltage of a capacitor is adjusted to control the speed, for example, when the weight of the movable portion reduces, it is necessary to reduce the charging capacitance or charging voltage of the capacitor in order to suppress an increase in closing speed. Because of the reduction, there arises a problem that shortage of a supplied current occurs at a timing at which a contact pressure spring is compressed, thereby causing insufficient closing (see reference numeral and symbol 101 and "A: SHORTAGE OF AMOUNT OF SUPPLIED CURRENT" of FIG. 2).

Further, drive characteristics of the electromagnetically operated unit (electromagnetic coil) are designed corresponding to a drive condition required for a predetermined vacuum valve. Therefore, there arises a problem that an electromagnetic operation cannot be shared with another electromagnetically operated switch using a vacuum valve and thus a reduction in cost cannot be realized.

The present invention has been made to solve the above-mentioned problems, and it is an object of the present invention to obtain an electromagnetically operated switching device capable of suppressing the increase in closing speed due to the change in weight of the movable portion of the switch by controlling a capacitance of a capacitor and a value of a resistor to adjust a supplied current characteristic.

Means for Solving the Problems

An electromagnetically operated switching device according to the present invention includes: a switch; an electromagnetically operated unit including: a movable core coupled to a movable contact of the switch; a fixed core fixedly provided in a peripheral portion of the movable core; and a coil provided on a fixed core, for driving the movable core, the electromagnetically operated unit switching the switch by driving the movable core; and a drive power source device for supplying a current to the coil to drive the electromagnetically operated unit, in which: the drive power source device includes a capacitor storing a charge for supplying the current to the coil; and the electromagnetically operated switching device includes a resistor connected in series with the capacitor on a path through which the coil is connected with the capacitor and through which a current for closing operation flows.

Effects of the Invention

The electromagnetically operated switching device according to the present invention includes: the switch; the electromagnetically operated unit including: the movable core coupled to the movable contact of the switch; the fixed core fixedly provided in a peripheral portion of the movable core; and the coil provided on a fixed core, for driving the movable core, the electromagnetically operated unit switching the switch by driving the movable core; and the drive power source device for supplying a current to the coil to drive the electromagnetically operated unit, in which: the drive power source device includes the capacitor storing a charge for supplying the current to the coil; and the electromagnetically operated switching device includes the resistor connected in series with the capacitor on the path through which the coil is connected with the capacitor and through which a current for closing operation flows. Therefore, the increase in closing speed due to a change in weight of the movable portion of the switch can be suppressed by controlling the capacitance of the capacitor and the value of the resistor to adjust a supplied current characteristic.

BEST MODE FOR CARRYING OUT THE INVENTION

Embodiment 1

Figure 1:
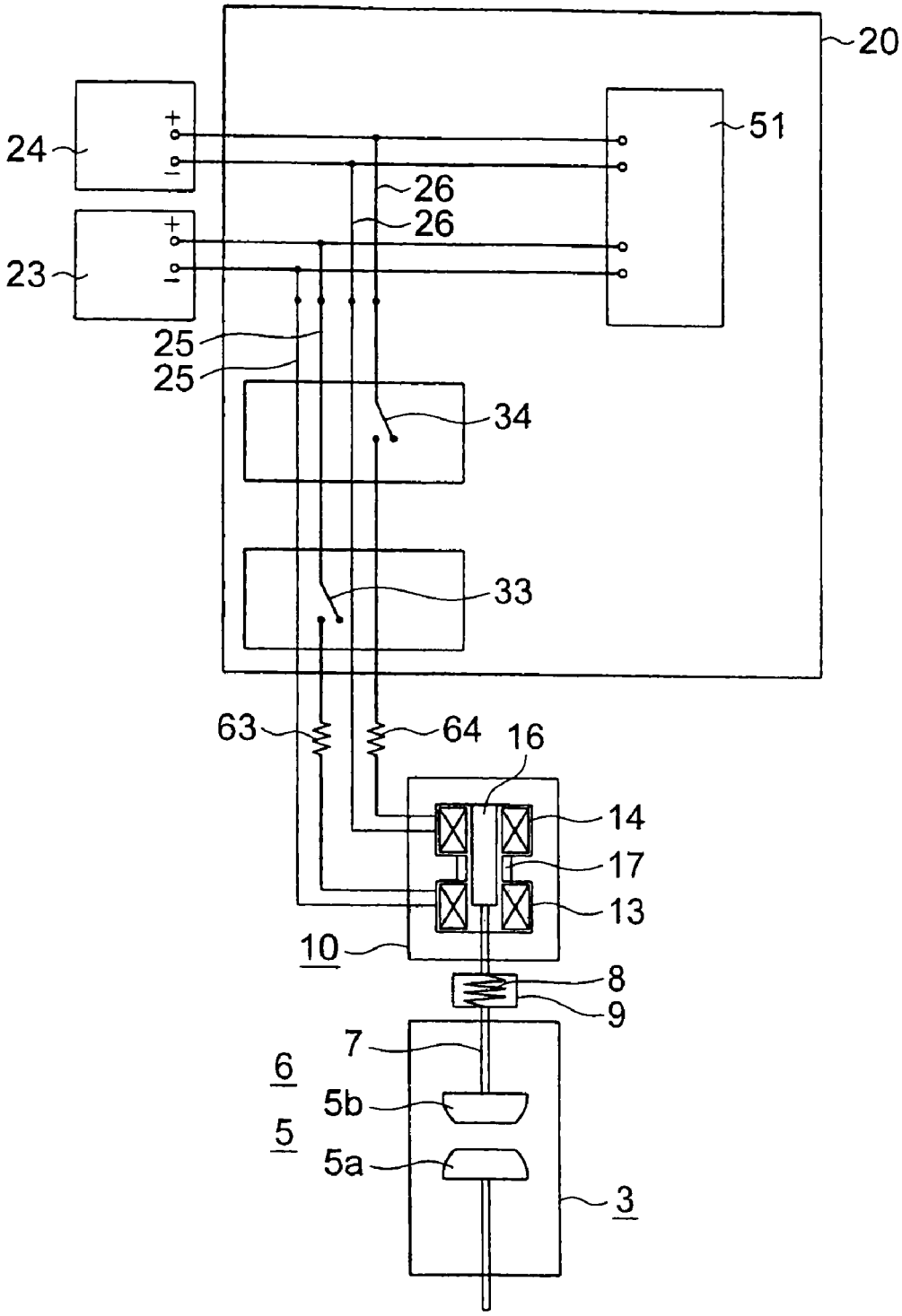
FIG. 1 is a structural diagram illustrating a structure of an electromagnetically operated switching device according to Embodiment 1 of the present invention.

FIG. 1 illustrates a structure of a vacuum breaker as an electromagnetically operated switching device according to Embodiment 1 of the present invention. As illustrated in FIG. 1, the electromagnetically operated switching device according to this embodiment broadly includes a vacuum valve 3, an electromagnetically operated electromagnet 10, and a drive power source device 20.

The vacuum valve 3 serving as a switch is constructed to accommodate a switching contact 5 in a vacuum container. The switching contact 5 includes a fixed contact 5*a* fixedly provided on a lower side of FIG. 1 and a movable contact 5*b* opposed to the fixed contact 5*a* at a predetermined interval in a longitudinal direction (hereinafter referred to as axial direction) of FIG. 1. A drive rod 7 is fixed to an end portion of the movable contact 5*b* which is not opposed to the fixed contact 5*a* in the axial direction. The movable contact 5*b* is horizontally moved by the drive rod 7 in the axial direction. Therefore, a movable portion 6 is composed of the movable contact 5*b* and the drive rod 7. The movable portion 6 is coupled to a movable core 16 of the electromagnetically operated electromagnet 10 through a contact pressure spring 8 and a spring bearing 9. The contact pressure spring 8 is located on the spring bearing 9. The contact pressure spring 8 and the spring bearing 9 are provided in a gap between the vacuum valve 3 and the electromagnetically operated electromagnet 10. A contact pressure between the movable contact 5*b* and the fixed contact 5*a* is held by the contact pressure spring 8.

The electromagnetically operated electromagnet 10 includes a closing coil 13, an opening coil 14, the movable core 16, and a permanent magnet 17. The movable core 16 made of a ferromagnetic material is coupled to the movable contact 5*b* of the vacuum valve 3 through the drive rod 7. The cylindrical permanent magnet 17 is fixedly provided as a fixed core in a peripheral portion of the movable core 16. The closing coil 13 and the opening coil 14 which serve as movable core driving electromagnetic coils are located with respect to the permanent magnet 17 and wound in an annular shape. As illustrated in FIG. 1, the closing coil 13 and the opening coil 14 are arranged in the axial direction at a predetermined interval. Therefore, the movable core 16 is located in the axial direction in a center portion of each of the closing coil 13 and the opening coil 14. The movable core 16 has a thin cylindrical shape, is inserted into the cylindrical permanent magnet 17, and is horizontally moved within the permanent magnet 17 in the axial direction by driving the closing coil 13 and the opening coil 14. The electromagnetically operated electromagnet 10 is constructed as described above. The vacuum valve 3 serving as the switch is switched by driving the movable core 16. In this embodiment, the structure of the cylindrical electromagnetically operated electromagnet 10 has been described. However, the present invention is not limited to this case, and the electromagnetically operated electromagnet 10 may have any structure as long as the movable core 16 is driven in a straight direction by the closing coil 13 or the opening coil 14. For example, an electromagnetically operated electromagnet described in JP 2004-288502 A may be used.

The drive power source device 20 includes a closing capacitor 23 and an opening capacitor 24 which store charges to be supplied to the closing coil 13 and the opening coil 14 of the electromagnetically operated electromagnet 10 described above. The closing capacitor 23 and the opening capacitor 24 are charged by a charging device 51. The closing capacitor 23 of the drive power source device 20 is connected with the closing coil 13 of the electromagnetically operated electromagnet 10 through connection lines 25. One of the connection lines 25 is provided with a closing instruction switch 33 and a resistor 63. The opening capacitor 24 of the drive power source device 20 is connected with the opening coil 14 of the electromagnetically operated electromagnet 10 through connection lines 26. One of the connection lines 26 is provided with an opening instruction switch 34 and a resistor 64. Note that the closing capacitor 23, the closing coil 13, and the resistor 63 serve as a so-called series-connected circuit. Similarly, the opening capacitor 24, the opening coil 14, and the resistor 64 serve as a so-called series-connected circuit. As illustrated in FIG. 1, paths for charging the capacitors 23 and 24 by the charging circuit 51 and paths for supplying currents from the capacitors 23 and 24 to the coils 13 and 14 are current paths partly including common paths. The resistors 63 and 64 are connected in series with the capacitors 23 and 24 on single-purpose paths through which currents for closing operation for connecting the coils 13 and 14 with the capacitors 23 and 24 flow. The drive power source device 20 supplies the currents to the closing coil 13 and the opening coil 14 to drive the electromagnetically operated electromagnet 10 serving as an electromagnetically operated unit.

Next, a switching operation of the vacuum valve 3 is described. In FIG. 1, the closing capacitor 23 and the opening capacitor 24 of the drive power source device 20 are continuously charged by the charging device 51 to have a predetermined voltage. When the closing instruction switch 33 is closed in an opening state of the movable contact 5*b* illustrated in FIG. 1, the charges stored in the closing capacitor 23 are supplied to the closing coil 13. Then, the movable core 16 is driven to a downward direction of FIG. 1 in the axial direction by the current flowing through the closing coil 13, whereby the movable contact 5*b* is brought into contact with the fixed contact 5*a* through the contact pressure spring 8 and the drive rod 7, thereby performing closing. In this case, after the movable contact 5*b* is brought into contact with the fixed contact 5*a*, the contact pressure spring 8 is further compressed to obtain a state in which the contact pressure between the contacts 5*a* and 5*b* is held by the compressed contact pressure spring 8. This state is maintained by magnetic fluxes of the permanent magnet 17 attached around the movable core 16, and thus becomes a closing state.

In the closing state, when the opening instruction switch 34 is closed to provide an opening instruction, the charges stored in the opening capacitor 24 are supplied to the opening coil 14. Then, the movable core 16 is driven to an upward direction of FIG. 1 in the axial direction by the current flowing through the opening coil 14. When the movable core 16 starts to move upwardly, the compressed contact pressure spring 8 first extends only, and the movable contact 5*b* and the drive rod 7 located on the vacuum valve 3 side do not move. After that, when the movable core 16 moves further upwardly, the movable contact 5*b*, the drive rod 7, the contact pressure spring 8, the spring bearing 9, and the movable core 16 integrally move upwardly. Then, the movable contact 5*b* is separated from the fixed contact 5*a*. Such a state is maintained by magnetic fluxes of the permanent magnet 17 attached around the movable core 16, and thus becomes the opening state.

Figure 2:
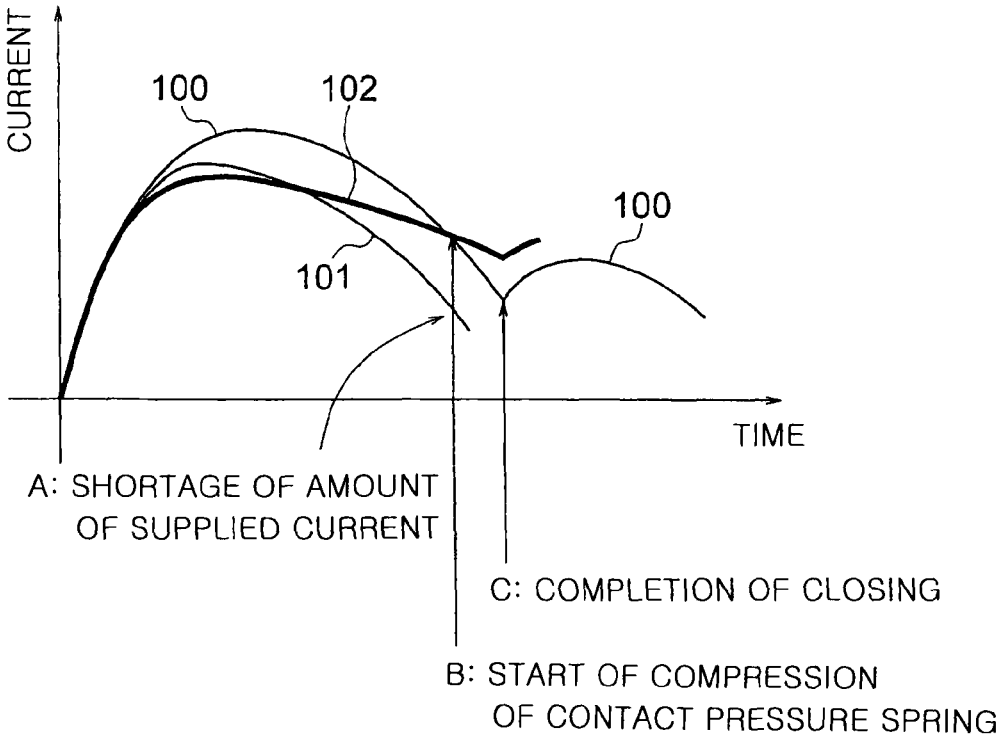
FIG. 2 is an explanatory diagram illustrating supplied current characteristics during a closing operation in Embodiment 1 of the present invention.

Hereinafter, an effect of the resistor 63 in an example of the closing operation is described with reference to FIGS. 1 and 2. In FIG. 2, the abscissa indicates a time and the ordinate indicates a current. Reference numeral 100 denotes a current waveform before weight reduction, 101 denotes a current waveform in a conventional case where a speed is adjusted by a reduction in capacitance after weight reduction, and 102 denotes a current waveform in a case where a speed is adjusted by increases in capacitance and resistance after weight reduction according to this embodiment.

1. When a weight of the movable portion 6 including the movable contact 5*b* of the vacuum valve 3 is reduced by a change in design, in the same circuit condition as the conventional case, an attractive force generated by the electromagnetically operated electromagnet 10 at the time of start of driving is equal to that generated thereby before weight reduction. Therefore, the movable portion 6 moves at a higher speed than that before weight reduction. In some cases, the speed is outside a specification range. In order to suppress the speed, a charging voltage V or a capacitance C of the closing capacitor 23 may be reduced. However, in this case, the amount of charges Q stored in the closing capacitor 23 reduces because of the relationship of Q=CV. The amount of charges Q reduces, and hence the amount of current during the closing operation after a lapse of a predetermined time period from the start of current supply normally reduces (see "A" of FIG. 2).

On the other hand, in a design condition in which a load generated on the contact pressure spring 8 is to be held constant, the attractive force which is generated by the electromagnetically operated electromagnet 10 and required at the time when the contact pressure spring 8 is compressed becomes constant, and hence the amount of current required at this time may be substantially equal to that before weight reduction (see "B" of FIG. 2). Therefore, when the charging voltage V or the capacitance C of the closing capacitor 23 is reduced to reduce a closing speed, closing cannot be performed because of the shortage of the attractive force generated by the electromagnetically operated electromagnet 10 at the time when the contact pressure spring 8 is compressed. In this case, in order to increase the capacitance C of the closing capacitor 23 to perform the closing operation using the closing capacitor 23 and the closing coil 13 of the electromagnetically operated electromagnet 10, when the resistor 63 is inserted into a current supply path so as to serve as a so-called series-connected circuit, the resistor 63 can be adjusted to suppress the amount of current I supplied to the closing coil 13 of the electromagnetically operated electromagnet 10 before the start of the closing operation, and hence the closing speed can be set to a value substantially equal to that before the reduction in weight of the movable portion 6 (see 102 of FIG. 2).

Further, because of the relationship of Q=CV, the amount of charges Q increases. Therefore, if the closing speed is equal to that before weight reduction, a timing at which the contact pressure spring 8 is compressed is reached at a time substantially equal to that before weight reduction. If the amount of current I is smaller than that before weight reduction and a time "t" that elapses until the timing at which the contact pressure spring 8 is compressed is reached is substantially equal to that before weight reduction, the amount of consumed charges Q is smaller than that before weight reduction because of the relation of I=dQ/dt. A change in inductance L of the closing coil 13 which is caused by the driving of the electromagnetically operated electromagnet 10 may be substantially the same as that before weight reduction, because the electromagnetically operated electromagnet 10 is identical to that before weight reduction and the closing speed is substantially equal to that before weight reduction.

Therefore, the amount of charges Q and the voltage V at the timing at which the contact pressure spring 8 is compressed are larger than those before weight reduction. Because the amount of charges Q and the voltage V at the timing at which the contact pressure spring 8 is compressed can be set to the values larger than those before weight reduction, when the capacitance C of the closing capacitor 23 and the value of the resistor 63 are adjusted to suitable values, the same amount of supplied current as that before weight reduction can be ensured at the timing at which the contact pressure spring 8 is compressed, and hence an attractive force capable of compressing the contact pressure spring 8 can be generated by the electromagnetically operated electromagnet 10, thereby preventing insufficient closing. Thus, even when a change in design such as a change in weight of the movable portion 6 occurs, this can be handled in a case where the same electromagnetically operated electromagnet 10 and the same drive power source device 20 are used and the capacitance of the capacitor and the value of the resistor are simply adjusted. It is thus unnecessary to newly develop the electromagnetically operated electromagnet 10 and the drive power source device 20.

2. Characteristics at the time of switching operation are performance required mainly from the vacuum valve 3. An opening speed range, a closing speed range, and a contact pressure condition are determined for each voltage, each current, each capacity, and each model. Therefore, the electromagnetically operated electromagnet 10 is designed to be able to satisfy the opening speed range, the closing speed range, and the contact pressure condition which are required for the vacuum valve 3. In a case where the electromagnetically operated electromagnet 10 is applied to, for example, a different kind of vacuum valve (hereinafter referred to as vacuum valve 3*b*), in particular, when the closing speed condition is equal to that of the vacuum valve 3, and when only the contact pressure condition of the vacuum valve 3*b* is higher than that of the vacuum valve 3, it is necessary to increase the value of current supplied to the closing coil when the above-mentioned contact pressure spring 8 is compressed, without an increase in current value at the time of start of driving. According to the method described above, when the capacitance of the closing capacitor 23 is increased and the value of the resistor 63 is increased, the value of current supplied to the closing coil when the contact pressure spring 8 is compressed can be increased without the increase in current value at the time of start of driving.

As described above, the electromagnetically operated switching device according to Embodiment 1 of the present invention has the structure in which the resistors 63 and 64 are connected in series with the closing capacitor 23 and the opening capacitor 24, respectively, on the paths through which the closing coil 13 and the opening coil 14 are connected with the closing capacitor 23 and the opening capacitor 24 and through which the currents for closing operation flow. Therefore, the capacitance of the closing capacitor 23 and the value of the resistor 63 (and/or the capacitance of the opening capacitor 24 and the value of the resistor 64) can be adjusted, and, even when the change in design such as the change in weight of the movable portion 6 occurs, this can be handled by adjusting the switching characteristics in the case where the same electromagnetically operated electromagnet 10 and the same drive power source device 20 are used and the capacitance of the capacitor and the value of the resistor are simply adjusted. Thus, it is unnecessary to newly develop the electromagnetically operated electromagnet 10 and the drive power source device 20. Further, another model of vacuum valve 3 can be handled by the same electromagnetically operated electromagnet 10, and hence the common use of the electromagnetically operated electromagnet 10 can be achieved and a cost of the electromagnetically operated electromagnet 10 can be reduced by a mass production effect. The drive power source device 20 can be also handled only by changing capacitors and resistors which are located in the outside, and hence a cost of the drive power source device 20 can be reduced by a mass production effect.

As described above, the electromagnetically operated switching device according to Embodiment 1 of the present invention includes the switching contact 5 (switch) and the electromagnetically operated electromagnet 10 (electromagnetically operated unit) for switching the switching contact 5. The electromagnetically operated electromagnet 10 includes the permanent electromagnet 17 (fixed core), the coils 13 and 14, the movable core 16 coupled to the movable contact 5*b* of the switching contact 5. The currents are supplied to the coils 13 and 14 to drive the movable core 16. The capacitors 23 and 24 storing the charges to be supplied to the coil 13 are provided. The resistors 63 and 64 are connected in series with the paths for supplying the currents from the capacitors 23 and 24 to the coils 13 and 14 to drive the movable core 16. According to such a structure, various designed switches can be driven using the same electromagnetically operated unit. That is, according to the present invention, the resistors are arranged in series with the main current supply paths from the capacitors to the electromagnetically operated device, and hence the following two effects can be obtained.

1. The supplied current characteristic can be controlled. Therefore, particularly in the closing operation, an increase in closing speed due to a change in weight of a movable part including the movable contact portion of the vacuum valve 3 (in particular, due to a reduction in weight thereof) can be suppressed, because an increase in capacitance of the capacitor and an increase in value of the resistor can be controlled to adjust the supplied current value. Thus, the requirement specifications of the vacuum valve can be satisfied, without changing a design of the drive power source device and the electromagnetically operated electromagnet.

2. A suitable supplied current characteristic can be obtained with respect to the drive characteristic required for each vacuum valve 3. Specifically, an electromagnetic force characteristic of the electromagnetically operated device can be controlled according to a supplied current characteristic based on a contact pressure spring condition, an opening spring condition, and a switching speed which are required for the switching characteristic of the vacuum valve.

Further, the switching contact 5 includes the contact pressure spring 8 for holding the contact pressure between the movable contact 5*b* and the fixed contact 5*a*. Therefore, various designed switching contacts (switches) can be driven using the same electromagnetically operated electromagnet 10. In this embodiment, the example in which the contact pressure spring 8 is used has been described. However, the present invention is not limited to this case. An opening spring for improving the opening speed of the movable contact 5*b* may be used. Alternatively, at least one of or both the contact pressure spring 8 and the opening spring may be provided. In any of the cases, an effect is obtained in which various designed switches can be driven using the same electromagnetically operated electromagnet 10.

Moreover, the charging device 51 for charging the capacitors 23 and 24 is provided. The paths for charging the capacitors 23 and 24 by the charging device 51 is provided. The current paths are provided common to the paths for charging the capacitors 23 and 24 by the charging device 51 and the paths for supplying the current from the capacitors 23 and 24 to the coils 13 and 14. The resistors 63 and 64 are connected in series with the single-purpose paths for supplying the current from the capacitors 23 and 24 to the coils 13 and 14. Therefore, a resistance loss during charging can be reduced.

The invention claimed is:

1. An electromagnetically operated switching device, comprising:

a switch including a fixed contact and a movable contact opposed to the fixed contact;

an electromagnetically operated unit including:

a movable core coupled to the movable contact;

a fixed core fixedly provided in a peripheral portion of the movable core; and a coil provided on the fixed core, for driving the movable core, wherein the electromagnetically operated unit switches the switch by driving the movable core;

a contact pressure spring for holding a contact pressure between the movable contact and the fixed contact;

a capacitor storing a charge for supplying a discharging current to the coil by discharging;

a charging device for charging the capacitor; and a resistor which is located outside the charging device and connected in series with conductive wires through which the discharging current flows from the capacitor to the coil for switching the switch, the resistor having a resistance value that reduces a peak value of the discharging current and adjusts a waveform of the discharging current to hold a coil current value required to generate a switching drive force opposed to a force of the contact pressure spring at a time when the contact pressure spring operates.

2. The electromagnetically operated switching device according to claim 1, further comprising:

a control switch in series with the capacitor and the resistor, the control switch configured to control the flow of discharging current from the capacitor through the resistor to the coil.

3. The electromagnetically operated switching device according to claim 1, wherein the coil is configured to move the movable core in a first direction when the discharging current flows from the capacitor to the coil, and the electromagnetically operated switching device further comprises:

a second coil;

a second capacitor; and a second resistor which is located outside the charging device and connected in series with second conductive wires through which a second discharging current flows from the second capacitor to the second coil for moving the movable core in a second direction, the second direction being opposite the first direction.

4. A vacuum valve including the electromagnetically operated switching device according to claim 1.

* * * * *